US011649148B2

(12) United States Patent
Suprina

(10) Patent No.: US 11,649,148 B2
(45) Date of Patent: May 16, 2023

(54) CORK SCREW BOTTLE LOCK

(71) Applicant: Scott F. Suprina, East Northport, NY (US)

(72) Inventor: Scott F. Suprina, East Northport, NY (US)

( * ) Notice: Subject to any disclaimer, the term of this patent is extended or adjusted under 35 U.S.C. 154(b) by 59 days.

(21) Appl. No.: 17/479,609

(22) Filed: Sep. 20, 2021

(65) Prior Publication Data

US 2022/0089422 A1 Mar. 24, 2022

Related U.S. Application Data

(60) Provisional application No. 63/081,556, filed on Sep. 22, 2020.

(51) Int. Cl.

| | |
|---|---|
| ***B67B 7/00*** | (2006.01) |
| ***B65D 39/16*** | (2006.01) |
| ***B67B 7/04*** | (2006.01) |
| ***B65B 7/28*** | (2006.01) |
| ***B65D 41/28*** | (2006.01) |

(52) U.S. Cl.

CPC ..... *B67B 7/0417* (2013.01); *B65B 7/2828* (2013.01); *B65D 41/28* (2013.01)

(58) Field of Classification Search

CPC ..... B65D 39/16; B65D 41/28; B67B 7/0417; B67B 7/06; B65B 7/2828

See application file for complete search history.

(56) References Cited

U.S. PATENT DOCUMENTS

| | | | | | |
|---|---|---|---|---|---|
| 624,384 | A | * | 5/1899 | Schroeder | B65D 39/16 215/354 |
| 640,860 | A | | 1/1900 | Baum | |
| 1,464,646 | A | * | 8/1923 | Cross | B65D 39/12 215/360 |
| 1,680,341 | A | | 8/1928 | Rosenthal | |
| 2,086,404 | A | | 7/1937 | Daniels | |
| 2,412,833 | A | * | 12/1946 | Prager | B65D 51/28 215/6 |
| 2,689,469 | A | | 9/1954 | Happe et al. | |
| 2,905,351 | A | | 9/1959 | Bernard | |
| 2,996,208 | A | | 8/1961 | Schroeder | |

(Continued)

FOREIGN PATENT DOCUMENTS

| | | |
|---|---|---|
| DE | 202006010440 U1 | 8/2006 |
| EP | 1953093 A1 | 8/2008 |

(Continued)

OTHER PUBLICATIONS

Extended European Search Report for Application No. 20154176.0, dated Apr. 9, 2021 (7 pages).

(Continued)

*Primary Examiner* — Andrew M Tecco

(74) *Attorney, Agent, or Firm* — Nutter McClennen & Fish LLP

(57) ABSTRACT

A cork screw bottle lock is used to secure a cork within a bottle and to facilitate removal of the cork from the bottle using a screw on/off mechanism. A cork screw bottle lock may include a retainer configured to secure a cork onto a bottle by a screw-on attachment of the retainer to the bottle. A method may include adding contents to a bottle and sealing the bottle using a cork secured to the bottle using a cork screw bottle lock.

20 Claims, 13 Drawing Sheets

100

(56) References Cited

U.S. PATENT DOCUMENTS

| | | | | |
|---|---|---|---|---|
| 3,089,605 | A | 5/1963 | Buonauro | |
| 3,307,727 | A * | 3/1967 | Garay | B65D 39/16 215/300 |
| 4,264,007 | A | 4/1981 | Hunt | |
| 4,446,980 | A * | 5/1984 | Oliver | B65D 39/16 215/276 |
| 6,164,473 | A | 12/2000 | Waldrip | |
| 6,568,549 | B1 * | 5/2003 | Miller | B67B 7/0441 81/3.15 |
| 6,662,959 | B1 | 12/2003 | Westerhold | |
| 6,905,038 | B2 | 6/2005 | Lopez | |
| 7,467,726 | B1 | 12/2008 | Izraelev | |
| 7,770,748 | B2 | 8/2010 | Elliott | |
| 7,775,393 | B1 | 8/2010 | Feldman et al. | |
| 8,196,764 | B2 | 6/2012 | Bernstein | |
| 2002/0153344 | A1 | 10/2002 | Pola et al. | |
| 2005/0092760 | A1 | 5/2005 | Westerhold | |
| 2005/0155974 | A1 | 7/2005 | Amron | |
| 2006/0273087 | A1 | 12/2006 | Crawford | |
| 2008/0011748 | A1 | 1/2008 | Meyer et al. | |
| 2010/0163559 | A1 | 7/2010 | Towers | |
| 2012/0204397 | A1 | 8/2012 | Tai | |
| 2012/0233968 | A1 | 9/2012 | Bernstein | |
| 2013/0306587 | A1 | 11/2013 | Park | |
| 2014/0165847 | A1 | 6/2014 | Suprina | |
| 2017/0071378 | A1 | 3/2017 | Suprina | |
| 2017/0360226 | A1 | 12/2017 | Zeidan | |
| 2019/0008296 | A1 | 1/2019 | Suprina | |
| 2019/0337675 | A1 | 11/2019 | Rajendran | |
| 2021/0127871 | A1 | 5/2021 | Newton | |
| 2021/0169251 | A1 | 6/2021 | Suprina | |
| 2021/0169252 | A1 | 6/2021 | Suprina | |
| 2021/0631097 | | 11/2021 | Suprina | |

FOREIGN PATENT DOCUMENTS

| | | | |
|---|---|---|---|
| GB | 463450 | A | 3/1937 |
| WO | 98/34846 | A1 | 8/1998 |
| WO | 03/099671 | A1 | 12/2003 |
| WO | 2017/109379 | A1 | 6/2017 |
| WO | 2018197518 | A1 | 11/2018 |

OTHER PUBLICATIONS

Extended European Search Report for Application No. 201198275.6, dated Feb. 18, 2022 (7 pages).

Europeon Patent Office Response to Extended European Search, Application No. 20154176.0, dated Dec. 10, 2021 (10 pages).

* cited by examiner

CORK SCREW BOTTLE LOCK

CROSS-REFERENCE TO RELATED APPLICATION(S)

This patent application claims the benefit of United States Provisional Patent Application No. 63/081,556 entitled CORK SCREW BOTTLE LOCK filed Sep. 22, 2020, which is hereby incorporated herein by reference in its entirety.

The subject matter of this patent application is related to the subject matter of U.S. patent application Ser. No. 16/831,297 entitled CONVERTIBLE BEVERAGE CONTAINER AND DRINKING APPARATUS filed Mar. 26, 2020, which claims the benefit of U.S. Provisional Patent Application No. 62/945,652 entitled CONVERTIBLE BEVERAGE CONTAINER AND DRINKING APPARATUS filed Dec. 9, 2019, each of which is hereby incorporated herein by reference in its entirety.

The subject matter of this patent application is related to the subject matter of U.S. patent application Ser. No. 16/104,538 entitled CONVERTIBLE BEVERAGE CONTAINER AND DRINKING APPARATUS filed Apr. 17, 2018 published as United States Patent Application Publication No. US 2019/0008296, which is hereby incorporated herein by reference in its entirety.

The subject matter of this patent application also is related to the subject matter of U.S. patent application Ser. No. 15/361,988 entitled CONVERTIBLE BEVERAGE CONTAINER AND DRINKING APPARATUS AND METHOD FOR MANUFACTURING filed Nov. 28, 2016, now U.S. Pat. No. 10,455,958, which is hereby incorporated herein by reference in its entirety.

The subject matter of this patent application also is related to the subject matter of U.S. patent application Ser. No. 13/713,575 entitled CONVERTIBLE BEVERAGE CONTAINER AND DRINKING APPARATUS AND METHOD FOR MANUFACTURING filed Dec. 13, 2012, now U.S. Pat. No. 9,504,341, which is hereby incorporated herein by reference in its entirety.

The subject matter of this patent application also may be related to the subject matter of U.S. patent application Ser. No. 13/200,445 entitled BEER BOTTLE GLASS filed Sep. 23, 2011, which is hereby incorporated herein by reference in its entirety.

FIELD OF THE INVENTION

The present invention relates generally to beverage containers, and, more particularly, to a system and method for corking a bottle.

BACKGROUND OF THE INVENTION

Many types of products are provided in bottles sealed with a cork, e.g., without limitation, sparkling wine, still wine, beer, ale, hard cider, malt beverage, hard liquor, mixed drink, soft drink, olive oil, vinegar, honey, medicament, etc. Particularly for situations in which the cork would be subject to pressure from the contents of the bottle (e.g., carbonated or sparkling beverages), the cork is typically secured within the bottle, e.g., using a hooded wire cage or foil wrap, in order to prevent the cork from being released prematurely such as during shipment or prior to opening the beverage for drinking. Of course, some bottles are sealed in other ways, such as using a screw-top or pop-top cap. Corks can be desirable for a number of reasons such as to promote proper aging of the beverage, to convey quality due to the tradition and aesthetics of work, and perhaps mostly for the "pop" when the beverage is opened.

SUMMARY OF VARIOUS EMBODIMENTS

In accordance with one embodiment, a cork screw bottle lock comprises a retainer configured to secure a cork onto a bottle by a screw-on attachment of the retainer to the bottle.

In various alternative embodiments, the retainer may be shaped as a ring or other shape and may be formed of any appropriate material such as, for example, metal, plastic, composite, or glass. The cork screw bottle lock may include one or more embellishment including, without limitation, at least one embellishment on the retainer. The retainer may be configured to secure the cork prior to insertion of the cork into the bottle and screw-on attachment of the retainer to the bottle or may be configured to secure the cork after the cork has been inserted into the bottle. The retainer may be configured to be rotated by a predetermined amount in a tightening direction to secure the cork screw bottle lock to the bottle and is configured to be rotated by a predetermined amount in a loosening direction to remove the cork, e.g., rotated by around ⅓ turn. The retainer may be configured to slip over or clamp around the cork.

The cork screw bottle lock may include one or more fasteners securing the cork to the retainer, such as, for example, a threaded rod that extends through the cork and the retainer. The cork screw bottle lock may include one or more gripping elements on the retainer, such as, for example, a raised structure, a recessed structure, or at least one handle. Gripping element(s) may be foldable or collapsible.

The top of the cork may extend from a top of the retainer and the retainer may include two handles extending therefrom, such that the cork screw bottle lock has the appearance of a small person. Such a cork screw bottle lock may include at least one embellishment such as, for example, a bow tie to evoke a groom, a veil to evoke a bride, or a sports helmet.

The cork screw bottle lock may include a tether such as to prevent the cork and/or retainer from being forcefully ejected or to prevent the cork and/or retainer from being separated or lost. The tether may be configured for tethering the cork screw bottle lock to the bottle and/or may be configured for tethering the cork screw bottle lock to a wrist or other object.

In accordance with other embodiments, a method comprises adding contents to a bottle and sealing the bottle using a cork secured to the bottle using a cork screw bottle lock.

Additional embodiments may be disclosed and claimed.

BRIEF DESCRIPTION OF THE DRAWINGS

The foregoing features of embodiments will be more readily understood by reference to the following detailed description, taken with reference to the accompanying drawings, in which:

FIG. 12 shows the handles in an open position and FIG. 13 shows the handles in a closed position.

It should be noted that the foregoing figures and the elements depicted therein are not necessarily drawn to consistent scale or to any scale. Unless the context otherwise suggests, like elements are indicated by like numerals.

DETAILED DESCRIPTION OF SPECIFIC EMBODIMENTS

In exemplary embodiments, a cork screw bottle lock is used to secure a cork within a bottle and to facilitate removal of the cork from the bottle using a screw on/off mechanism.

Figure 1:
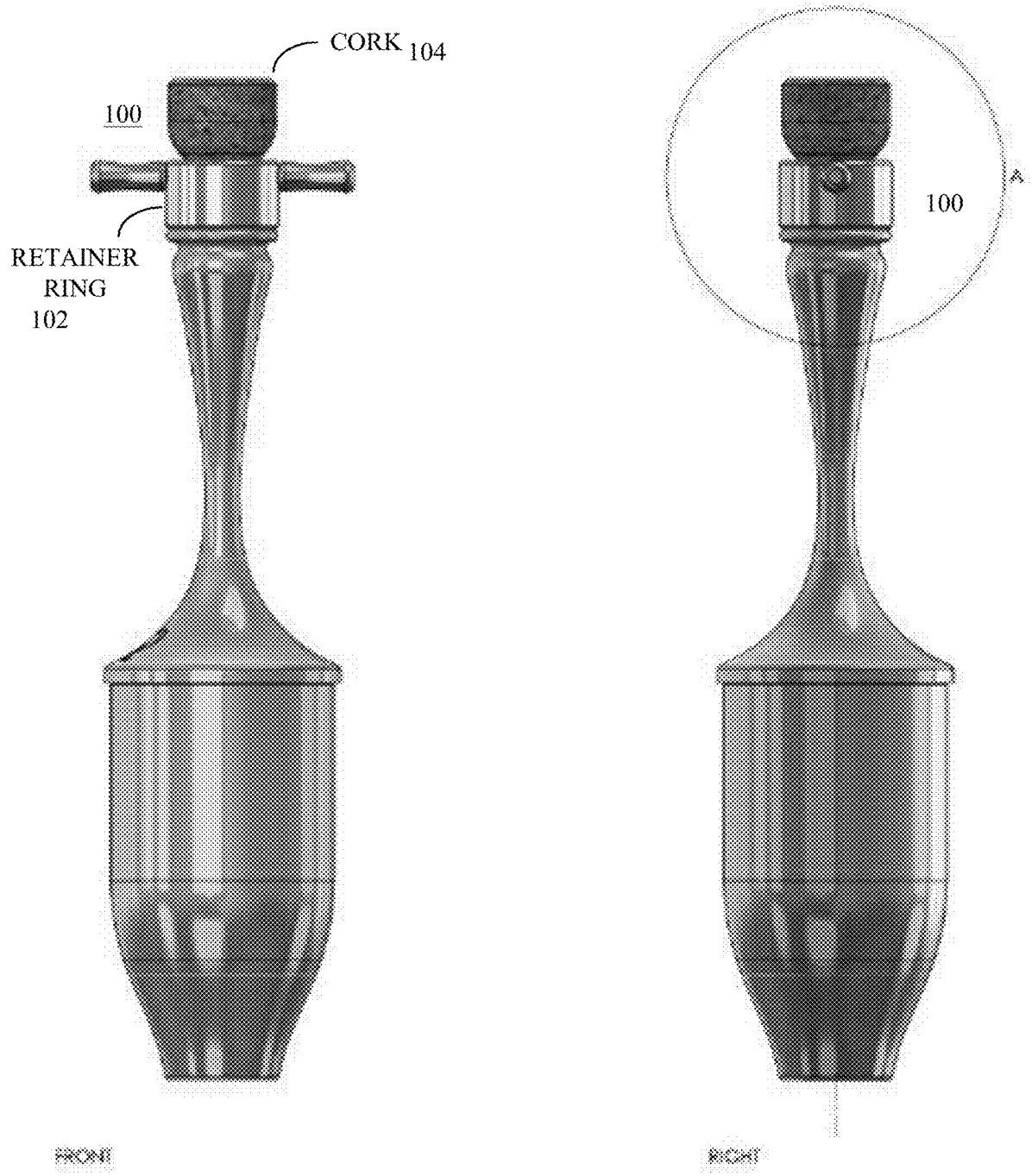
FIG. 1 is a schematic diagram showing a cork screw bottle lock for corking a bottle, in accordance with one exemplary embodiment.

FIG. 1 is a schematic diagram showing a cork screw bottle lock for corking a bottle, in accordance with one exemplary embodiment. In this example, the cork screw bottle lock includes a retainer 102 (which in this example is shaped as a ring, although other shapes and configurations are possible, e.g., a cube) that circumscribes a portion of the cork 104, allowing the bottom portion of the cork to be inserted into the top of the bottle followed by the retainer being rotated by a predetermined amount in a tightening direction (e.g., ⅓ turn clockwise when viewed from the top) to secure the cork screw bottle lock (and hence also the cork) to the bottle. The cork can be removed by rotating the retainer by a predetermined amount in a loosening direction (e.g., ⅓ turn counterclockwise when viewed from the top) and then using the retainer or the top of the cork itself to pull out the cork. The cork screw bottle lock can be formed of any appropriate material, e.g., glass, plastic, metal, or composite. In this example, the cork screw bottle lock is shown being used with a convertible beverage container and drinking apparatus of the type described in U.S. patent application Ser. No. 16/831,297 entitled CONVERTIBLE BEVERAGE CONTAINER AND DRINKING APPARATUS filed Mar. 26, 2020 and U.S. patent application Ser. No. 16/104,538 entitled CONVERTIBLE BEVERAGE CONTAINER AND DRINKING APPARATUS filed Apr. 17, 2018 published as United States Patent Application Publication No. US 2019/0008296, which were incorporated by reference above, although it should be noted that cork screw bottle locks can be adapted for any bottle including glass, plastic, metal, or composite for use with any type of contents whether sparkling or still. In this example, the cork screw bottle lock is shown with optional gripping elements in the form of a pair of opposing handles, which are just one type of virtually unlimited types of gripping elements that can be included to facilitate gripping and rotating of the retainer such as for securing the retainer and cork to the bottle or removing the retainer and cork from the bottle (other types of gripping elements can include, for example, raised and/or recessed structures). The handles or other gripping elements can be used for aesthetic purposes as discussed further below.

Figure 2:
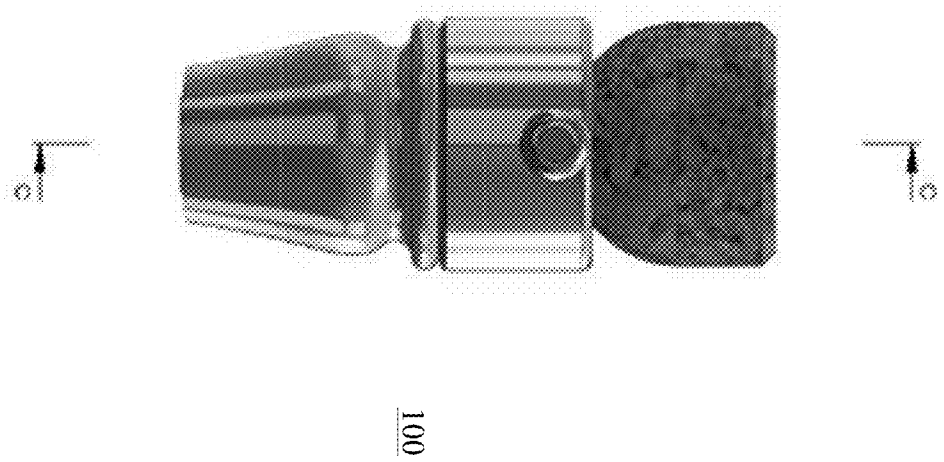
FIG. 2 is a schematic diagram showing Detail A from FIG. 1.

FIG. 2 is a schematic diagram showing Detail A from FIG. 1.

Figure 3:
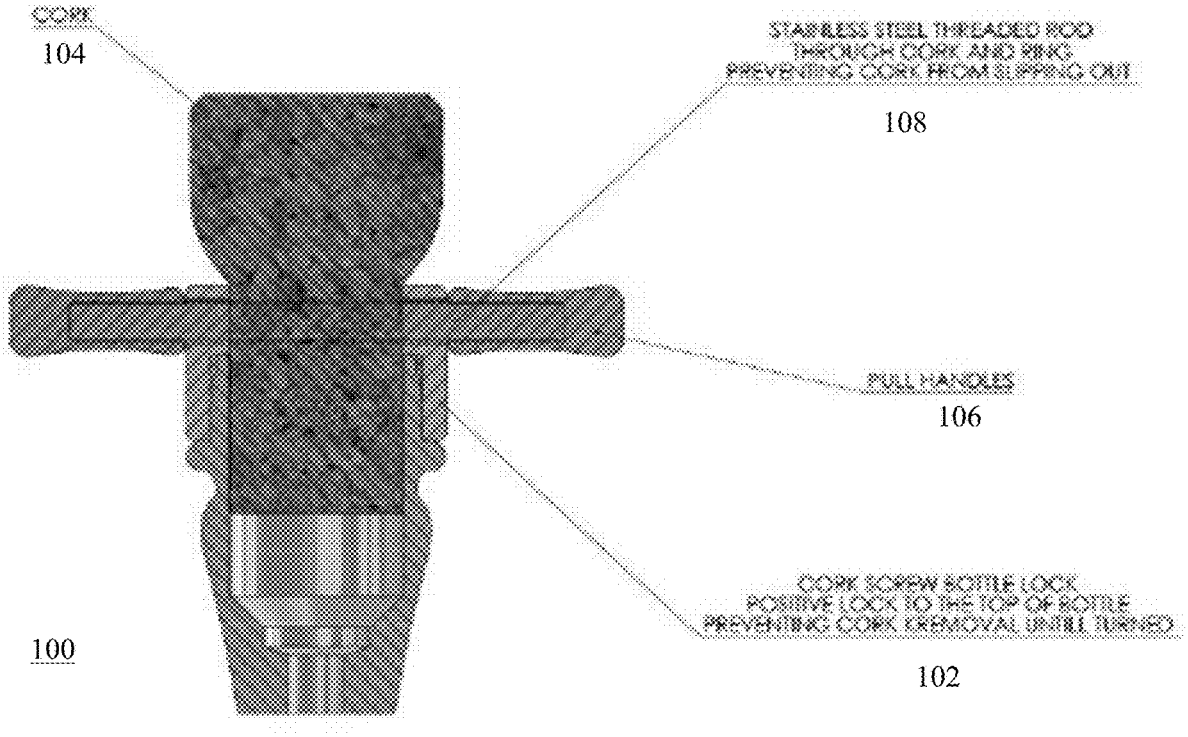
FIG. 3 is a schematic diagram showing a cross-sectional view at Section C-C of FIG. 2.

FIG. 3 is a schematic diagram showing a cross-sectional view at Section C-C of FIG. 2. In this example, the cork is secured to the retainer of the cork screw bottle lock via a threaded rod 108 passing through the cork and the retainer and secured by the two handles 106 (e.g., which can be configured to screw onto the threaded rod). Among other things, this arrangement will prevent the cork from being removed or expelled while the retainer is tightened onto the bottle and also will facilitate removal of the cork along with the retainer after the retainer is loosened from the bottle. It should be noted that the cork can be secured to the retainer in other ways (e.g., a fastener such as a nail or screw, an adhesive, crimping of the retainer onto the cork, through configuration of the cork to be held by the retaining ring, etc.), and the present invention is not limited to any particular way of securing the cork to the retainer. Generally speaking, with the cork physically secured to the retainer, rotation of the retainer when tightening or loosening would cause a corresponding rotation of the cork, which could be helpful when removing the cork. However, it should be noted that, in some embodiments, it may not be necessary to physically secure the cork to the retainer such that the retainer could be rotatable relative to the cork without causing rotation of the cork when the retainer is rotated to tighten or loosen the retainer.

Figure 4:
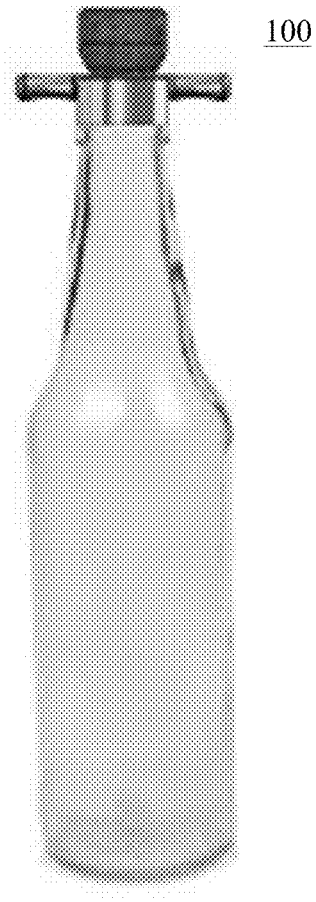
FIG. 4 is a schematic diagram showing the cork screw bottle lock of the type shown in FIGS. 1-3 used with another type of bottle.

FIG. 4 is a schematic diagram showing the cork screw bottle lock of the type shown in FIGS. 1-3 used with another type of bottle. As discussed above, cork screw bottle locks can be adapted for any bottle including glass, plastic, metal, or composite for use with any type of contents whether sparkling or still.

Figure 5:
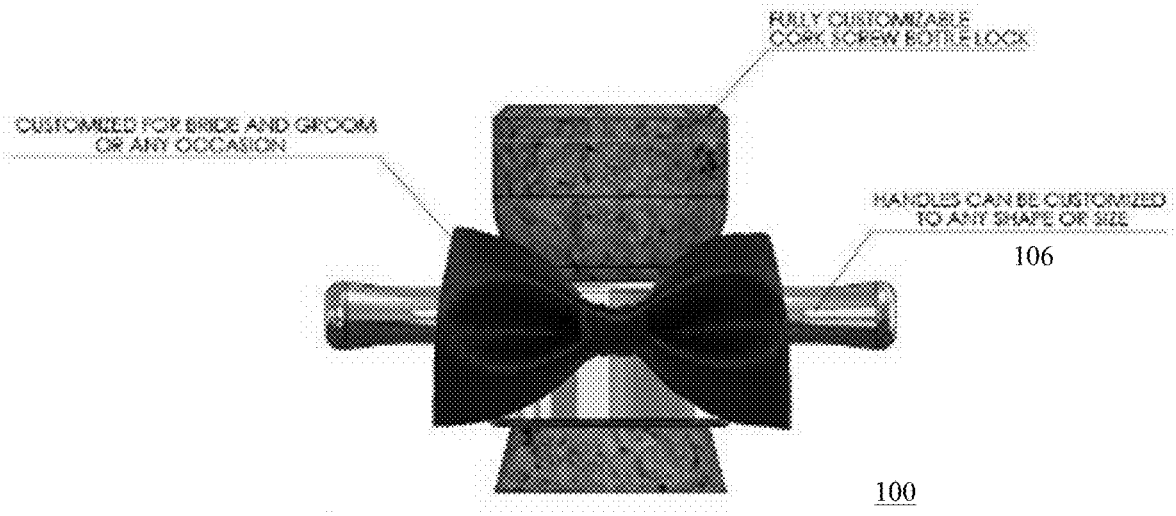
FIG. 5 is a schematic diagram showing some non-limiting examples of how the cork screw bottle lock can be embellished and used for aesthetic purposes in the context of a wedding, with one version of the cork screw bottle lock including a bow tie and one version of the cork screw bottle lock including a veil.
Figure 5:
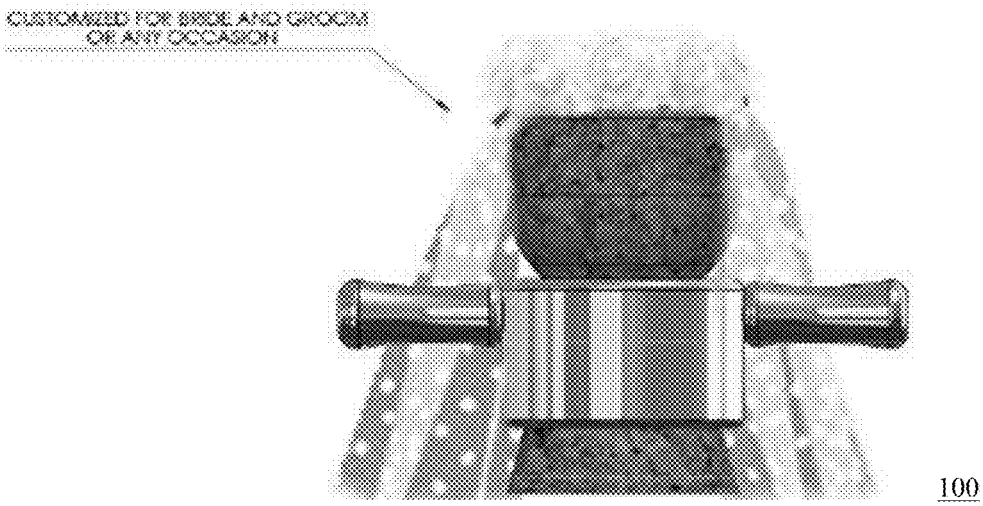

FIG. 5 is a schematic diagram showing some non-limiting examples of how the cork screw bottle lock can be embellished and used for aesthetic purposes in the context of a wedding, with one version of the cork screw bottle lock including a bow tie and one version of the cork screw bottle lock including a veil. These examples take advantage of the particular handle configuration shown in FIG. 1, where the handles look like arms of a small person and the cork top looks like a person's head, such that the additional of a bow tie is suggestive of a groom and the addition of a veil is suggestive of a bride. Of course, other types of gripping elements and/or other types of embellishments can be used for other types of occasions, tributes, or representations, e.g., wedding showers, baby showers, religious events (e.g., adding appropriate embellishments for confirmations, Bar and Bat Mitzvahs, Quinceaneras, etc.), retirement parties, birthday parties (e.g., embellishing with balloons or the person's age), holiday parties (e.g., embellishments related to New Year's Eve, Valentine's Day, Fourth of July, Thanksgiving, Christmas, etc.), political events (e.g., embellishment with political party symbols), sporting events and teams (e.g., adding helmets, caps, or jerseys with different players' names or numbers such as for a championship game), personal tributes (e.g., adding a face, hair style, glasses, etc.), etc. These and other types of embellishments can be added to the cork screw bottle lock in any appropriate manner, e.g., glued onto the retainer, secured to the retainer using a fastener which could be part of the retainer itself (e.g., a post, snap, clip, or other support), held onto the retainer via magnet, etc., and the present invention is not limited to any particular type of embellishment or manner of adding embellishment to the cork screw bottle lock.

Figure 6:
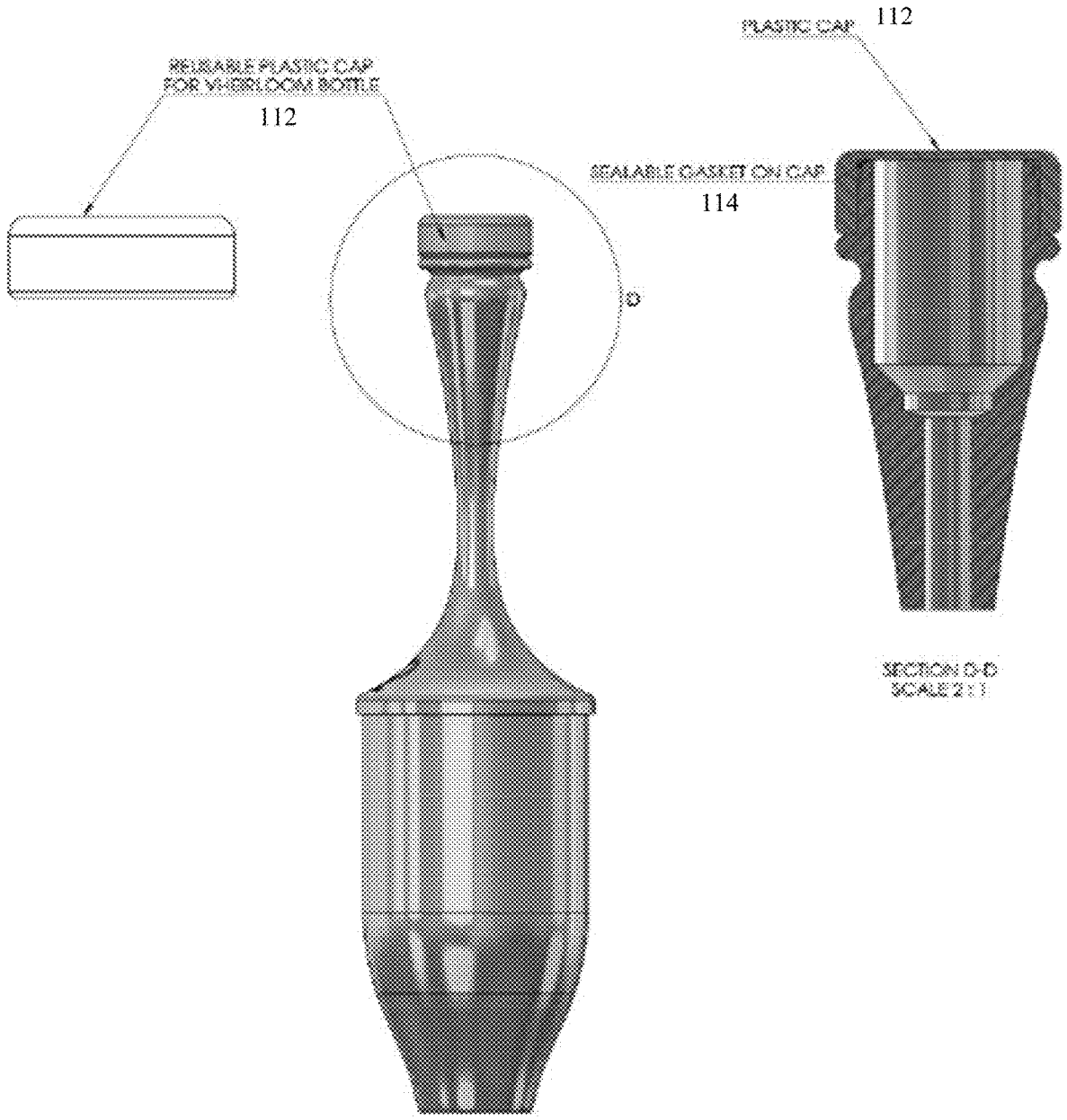
FIG. 6 is a schematic diagram showing a reusable cap, in accordance with one exemplary embodiment.

The inventor recognizes that once the cork and retainer are removed from the bottle, there generally would be no good way to re-seal the bottle or re-use the bottle in the future. Thus, the inventor envisions optionally providing a reusable cap 112 (e.g., a plastic cap), for example, as shown in FIG. 6. The cap 112 may include a sealable gasket 114, for example, to help with sealing the contents of the bottle. The present invention is not limited to inclusion of a reusable cap or to any particular type of reusable cap.

Figure 7:
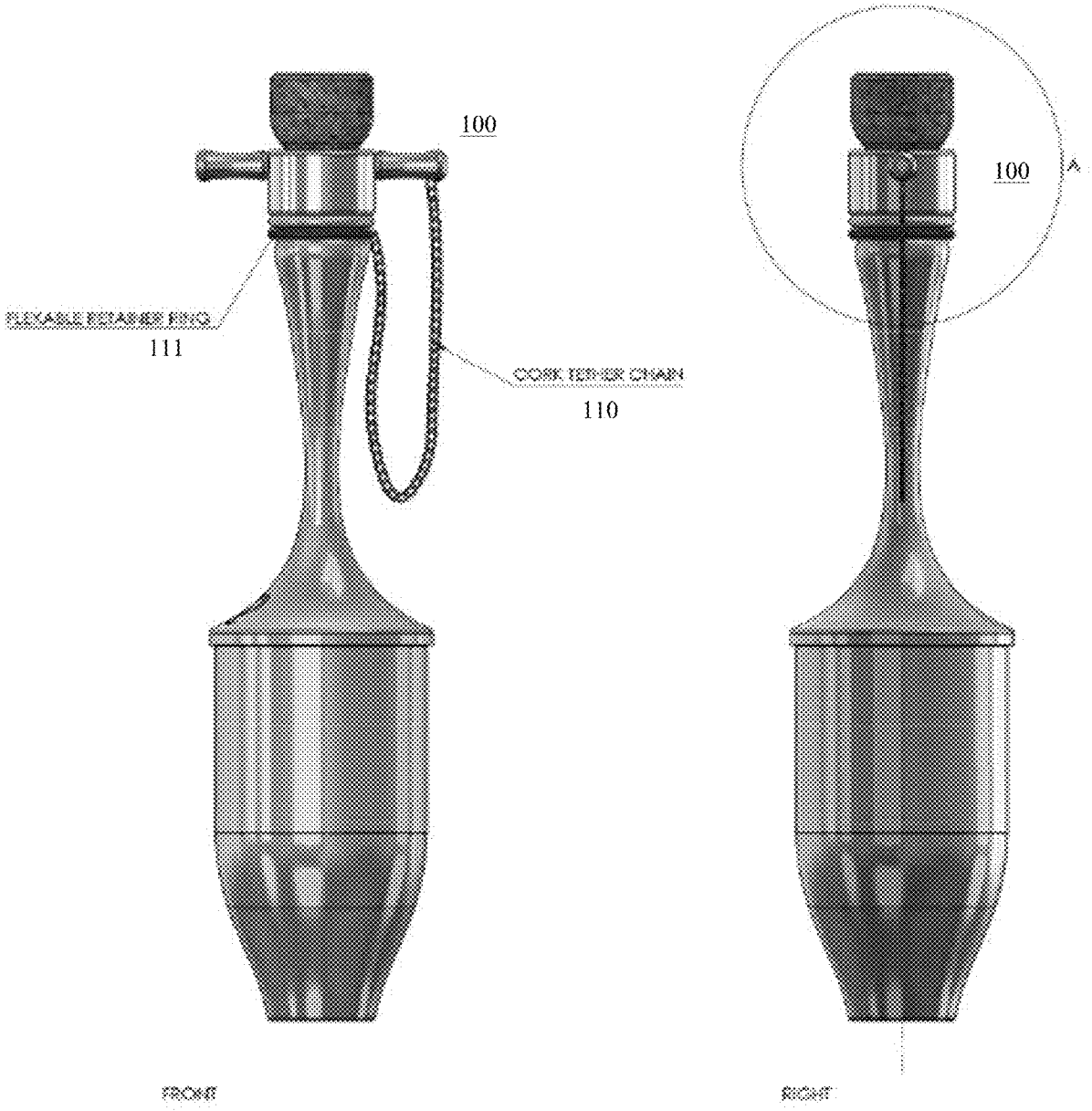
FIG. 7 is a schematic diagram showing a cork screw bottle lock with tether, in accordance with one exemplary embodiment.
Figure 8:
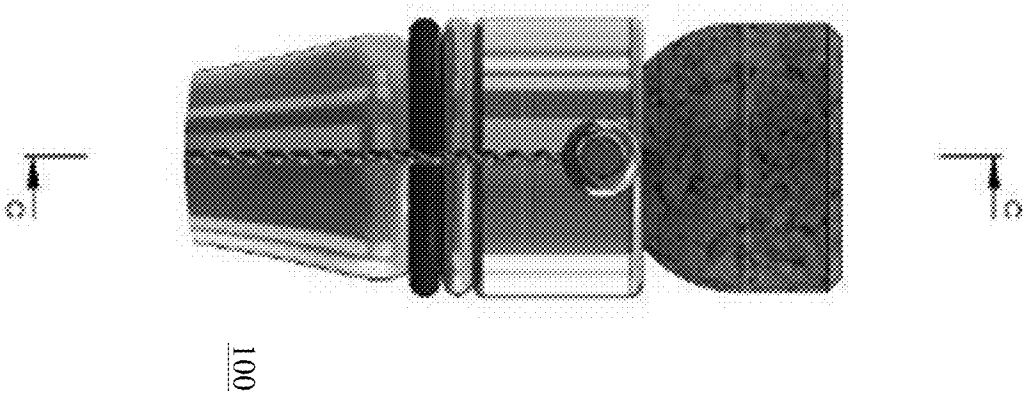
FIG. 8 is a schematic diagram showing Detail A from FIG. 7.
Figure 9:
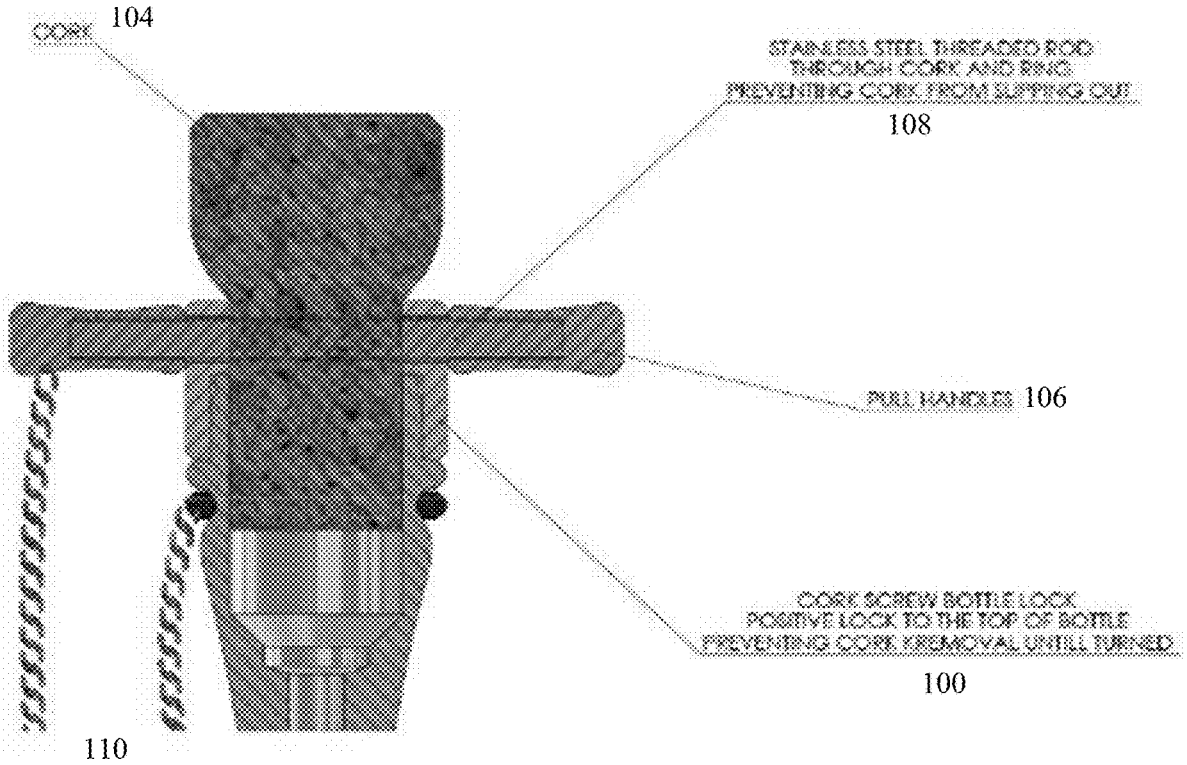
FIG. 9 is a schematic diagram showing a cross-sectional view at Section C-C of FIG. 8.

The inventor also envisions optional use of a tether such as for aesthetics, to keep the cork screw bottle lock attached to the bottle, or to prevent the cork screw bottle lock from traveling far should the cork screw bottle lock be forcefully ejected after the retainer is loosened. FIG. 7 is a schematic diagram is a schematic diagram showing a cork screw bottle lock with tether 110, in accordance with one exemplary embodiment. FIG. 8 is a schematic diagram showing Detail A from FIG. 7. FIG. 9 is a schematic diagram showing a cross-sectional view at Section C-C of FIG. 8. In this example, the tether is a chain that is secured at one end to the cork screw bottle lock (e.g., to one of the handles in this example) and at the other end to the bottle (e.g., using a flexible retaining ring 111 in this example). Of course, tethers 110 could be made of other materials (e.g., wire, elastic, etc.) and could be configured to be secured to the bottle, secured to a person's wrist, or otherwise secured or held, and the present invention is not limited to use of a tether or to any particular tether arrangement.

Figure 10:
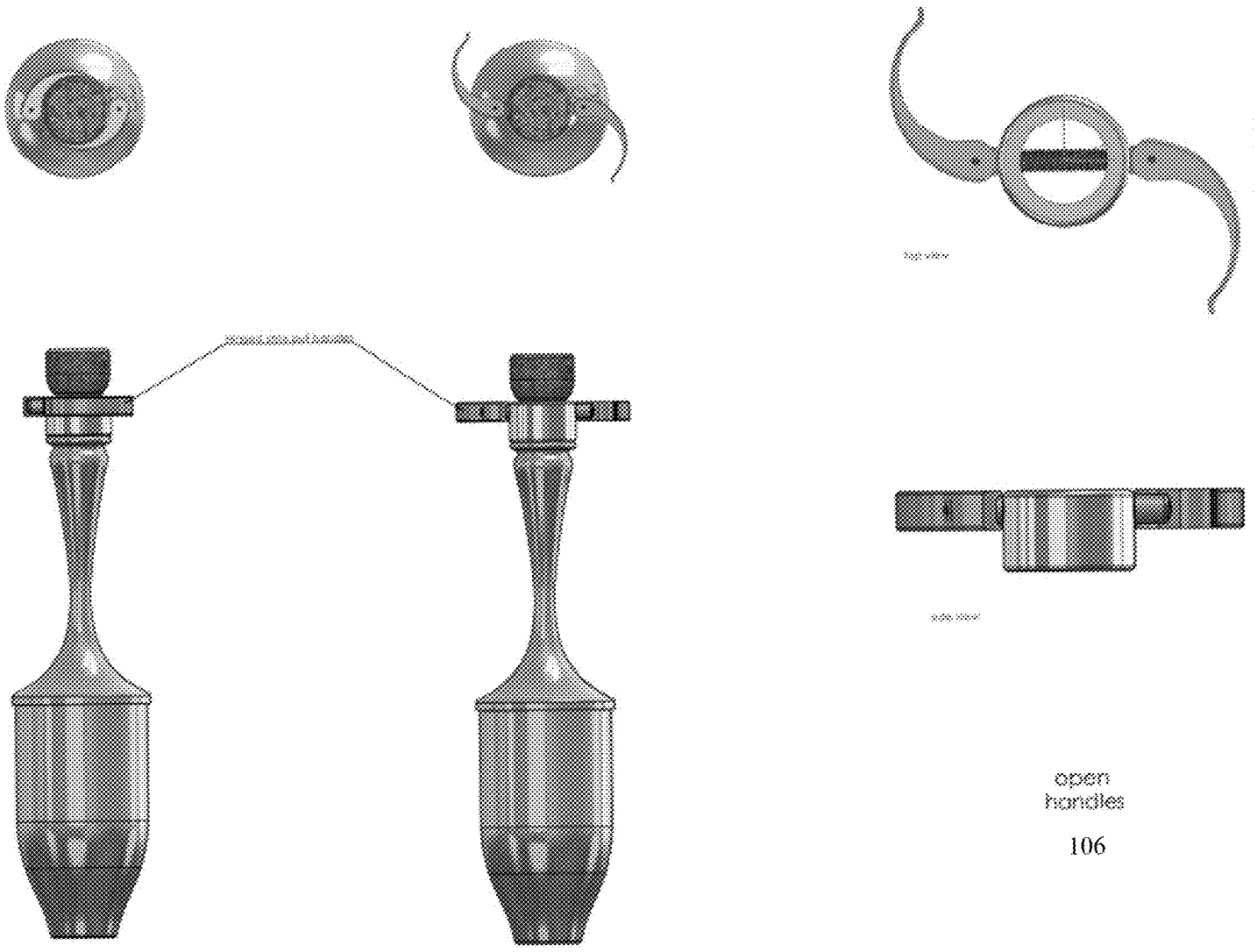
FIG. 10 schematically shows an exemplary embodiment in which handles are both curved and foldable.
Figure 11:
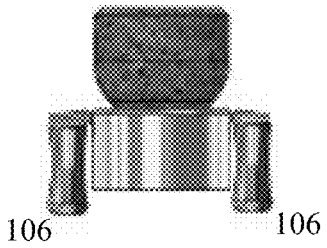
FIG. 11 schematically shows an exemplary embodiment in which handles fold down rather than to the side as in FIG. 10.
Figure 12:
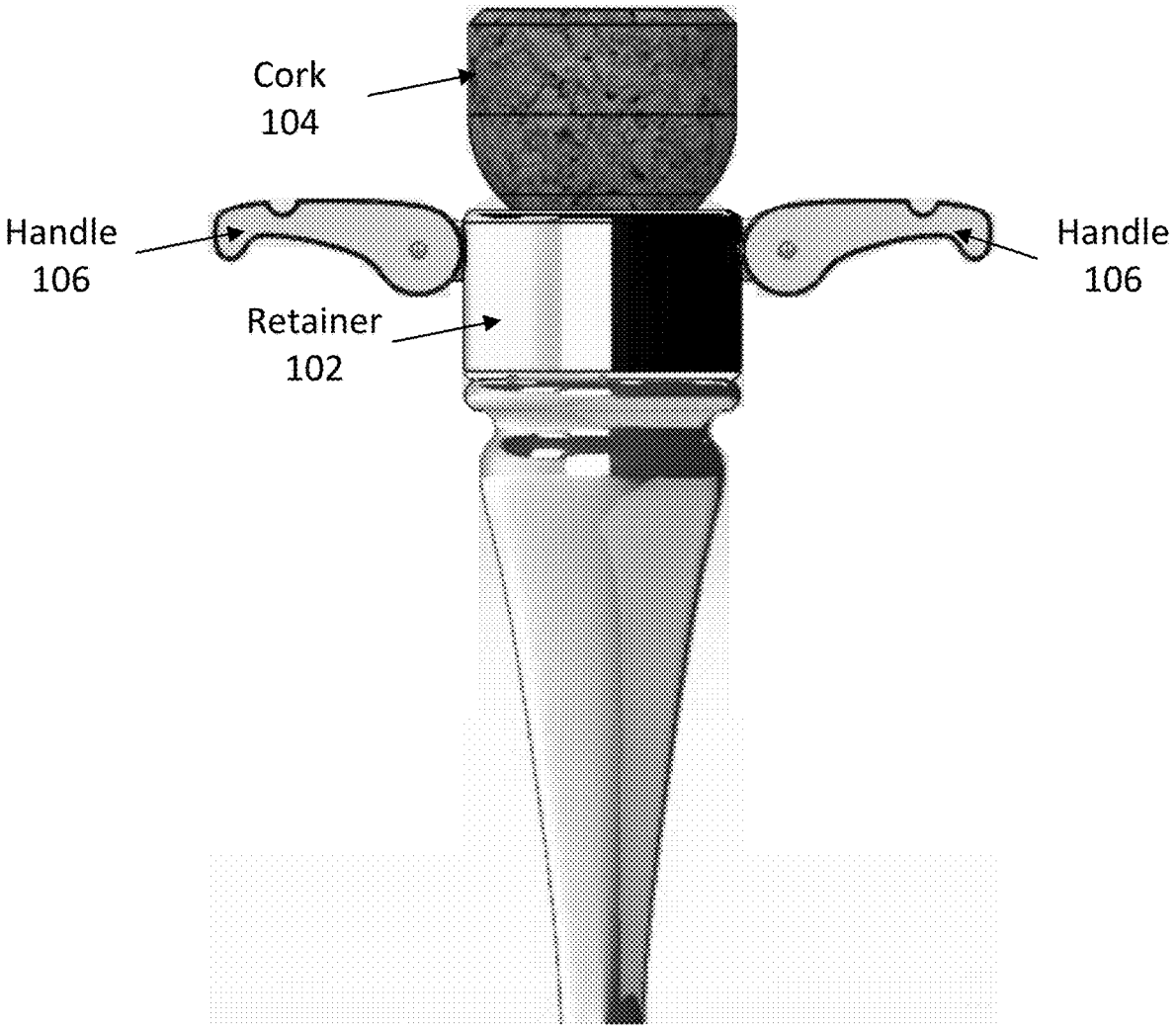
FIGS. 12 and 13 schematically show another exemplary embodiment in which handles fold down rather than to the side as in FIG. 10, where
Figure 13:
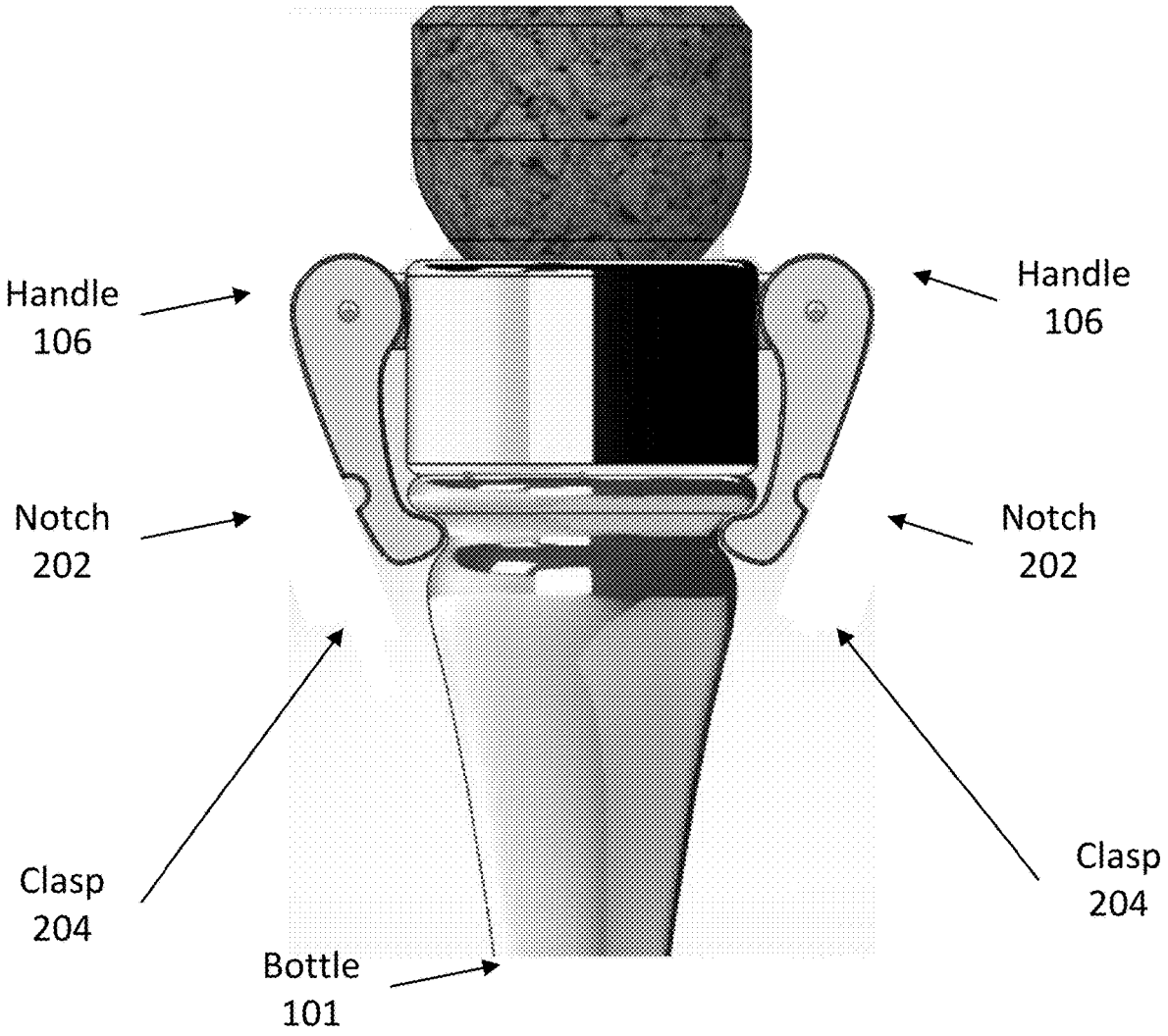

It should be noted that gripping elements, when included on the cork screw bottle lock, can include any number and/or configuration of gripping elements. For example, in the case of handles, cork screw bottle locks can include one handle, two handles, three handles, four handles, five handles, or more handles, which can be separate or attached (e.g., connected by a ring in an arrangement that could resemble a wagon wheel, ship's wheel, etc.). Additionally or alternatively, raised or extended gripping elements such as the handles shown in FIG. 1 can be customized to any shape or size and also can be foldable or collapsible. FIG. 10 schematically shows an exemplary embodiment in which the handles 106 are both curved and foldable so that they fit closely to the retainer when in the folded position and are extendable to facilitate loosening of the retainer and removal of the cork screw bottle lock. FIG. 11 schematically shows an exemplary embodiment in which the handles 106 fold down rather than to the side as in FIG. 10. FIGS. 12 and 13 schematically show another exemplary embodiment in which handles 106 fold down rather than to the side as in FIG. 10, where FIG. 12 shows the handles 106 in an open position and FIG. 13 shows the handles 106 in a closed position. As shown in FIG. 13, the handles may include features such as clasps 204 to engage with a rim of the bottle 101 or notches 202 that can be used, for example, to secure an elastic band, string, wire, or other fastener to hold the handles 106 in the closed position such as during storage or shipping. Of course, other configurations are possible, and the present invention is not limited to any particular configuration or manner of folding or collapsing of gripping elements.

It should be noted that, for purposes of this disclosure and any claims, the term "cork screw bottle lock" can be used to refer to the retainer alone, and/or with any gripping elements, and/or with any embellishments, and/or with a tether, and/or with a cork.

Similarly, it should be noted that, for purposes of this disclosure and any claims, the term "retainer" can be used to refer to the retainer alone, and/or with any gripping elements, and/or with any embellishments. Thus, for example, attachment of a tether to the retainer can include attachment to the retainer, attachment to a handle or other gripping element on the retainer, or attachment to an embellishment on the retainer.

Exemplary embodiments also include use of such cork screw bottle locks to seal contents into a bottle. Thus, exemplary embodiments include a method in which contents are added to a bottle (e.g., without limitation, sparkling wine, still wine, beer, ale, hard cider, malt beverage, hard liquor, mixed drink, soft drink, olive oil, vinegar, honey, medicament, etc.) and then the bottle is sealed using a cork screw bottle lock. In various alternative embodiments, the cork may be positioned or otherwise secured in the cork screw bottle lock either before the cork is inserted into the bottle or after the cork is inserted into the bottle which may be possible in certain situations depending, for example, on the shape of the cork, on the configuration of the cork screw bottle lock itself, or on the manner (if any) in which the cork is secured to the cork screw bottle lock. Thus, for example, the cork screw bottle lock may be configured to slip over an already-inserted cork or to clamp around an already-inserted cork.

Various embodiments of the present invention may be characterized by the potential claims listed in the paragraphs following this paragraph (and before the actual claims provided at the end of the application). These potential claims form a part of the written description of the application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public. Nor are these potential claims intended to limit various pursued claims.

Without limitation, potential subject matter that may be claimed (prefaced with the letter "P" so as to avoid confusion with the actual claims presented below) includes:

P1. A cork screw bottle lock comprising a retainer configured to secure a cork onto a bottle by a screw-on attachment of the retainer to the bottle.

P2. A cork screw bottle lock according to claim P1, further comprising:

at least one fastener securing the cork to the retainer.

P3. A cork screw bottle lock according to claim P2, wherein the at least one fastener securing the cork to the retainer comprises a threaded rod that extends through the cork and the retainer.

P4. A cork screw bottle lock according to claim P1, further comprising at least one gripping element on the retainer.

P5. A cork screw bottle lock according to claim P4, wherein the at least one gripping element comprises a raised structure.

P6. A cork screw bottle lock according to claim P4, wherein the at least one gripping element comprises a recessed structure.

P7. A cork screw bottle lock according to claim P4, wherein the at least one gripping element comprises at least one handle.

P8. A cork screw bottle lock according to claim P4, wherein the at least one gripping element is foldable or collapsible.

P9. A cork screw bottle lock according to claim P1, wherein a top of the cork extends from a top of the retainer and the retainer includes two handles extending therefrom, such that the cork screw bottle lock has the appearance of a small person.

P10. A cork screw bottle lock according to claim P9, further comprising at least one embellishment.

P11. A cork screw bottle lock according to claim P10, wherein the at least one embellishment includes a bow tie to evoke a groom.

P12. A cork screw bottle lock according to claim P10, wherein the at least one embellishment includes a veil to evoke a bride.

P13. A cork screw bottle lock according to claim P10, wherein the at least one embellishment includes a sports helmet.

P14. A cork screw bottle lock according to claim P1, wherein the retainer is shaped as a ring.

P15. A cork screw bottle lock according to claim P1, further comprising at least one embellishment.

P16. A cork screw bottle lock according to claim P15, wherein the at least one embellishment is on the retainer.

P17. A cork screw bottle lock according to claim P1, wherein the retainer is configured to be rotated by a predetermined amount in a tightening direction (e.g., ⅓ turn clockwise when viewed from the top) to secure the cork screw bottle lock (and hence also the cork) to the bottle and is configured to be rotated by a predetermined amount in a loosening direction (e.g., ⅓ turn counterclockwise when viewed from the top) to remove the cork.

P18. A cork screw bottle lock according to claim P1, further comprising a tether.

P19. A cork screw bottle lock according to claim P18, wherein the tether is configured for tethering the cork screw bottle lock to the bottle.

P20. A cork screw bottle lock according to claim P18, wherein the tether is configured for tethering the cork screw bottle lock to a wrist or other object.

P21. A cork screw bottle lock according to claim P1, wherein the retainer is formed of metal.

P22. A cork screw bottle lock according to claim P1, wherein the retainer is formed of plastic.

P23. A cork screw bottle lock according to claim P1, wherein the retainer is formed of composite.

P24. A cork screw bottle lock according to claim P1, wherein the retainer is formed of glass.

P25. A method comprising adding contents to a bottle and sealing the bottle using a cork screw bottle lock according to any one of claims P1 to P24.

The present invention may be embodied in other specific forms without departing from the true scope of the invention, and numerous variations and modifications will be apparent to those skilled in the art based on the teachings herein. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A cork screw bottle lock comprising:

a retainer that secures a cork onto a bottle by a screw-on attachment of the retainer to the bottle; and a threaded rod that extends through the cork and the retainer to secure the cork to the retainer.

2. A cork screw bottle lock according to claim 1, wherein the retainer is secured to the cork prior to insertion of the cork into the bottle and screw-on attachment of the retainer to the bottle.

3. A cork screw bottle lock according to claim 1, wherein the retainer is secured to the cork after the cork has been inserted into the bottle.

4. A cork screw bottle lock according claim 1, wherein the retainer is configured to be rotated by a predetermined amount in a tightening direction to secure the cork screw bottle lock to the bottle and is configured to be rotated by a predetermined amount in a loosening direction to remove the cork.

5. A cork screw bottle lock according to claim 1, wherein the retainer is configured to slip over or clamp around the cork.

6. A cork screw bottle lock according to claim 1, further comprising a first handle secured to a first end of the threaded rod and a second handle secured to a second end of the threaded rod.

7. A cork screw bottle lock according to claim 6, wherein the first and second handles are foldable or collapsible.

8. A cork screw bottle lock according to claim 1, wherein a top of the cork extends from a top of the retainer and the retainer includes two handles extending therefrom, such that the cork screw bottle lock has the appearance of a small person.

9. A cork screw bottle lock according to claim 1, further comprising at least one of:

an embellishment; or a tether configured for tethering the cork screw bottle lock to at least one of the bottle, a wrist, or another object.

10. A method comprising:

providing a cork screw bottle lock according to claim 1;

adding contents to a bottle; and sealing the bottle using a cork secured to the bottle using the cork screw bottle lock.

11. A cork screw bottle lock comprising:

a retainer that secures a cork onto a bottle by a screw-on attachment of the retainer to the bottle with a top of the cork extending from a top of the retainer; and at least one gripping element on the retainer, wherein the at least one gripping element is foldable or collapsible.

12. A cork screw bottle lock according to claim 11, wherein the retainer is secured to the cork prior to insertion of the cork into the bottle and screw-on attachment of the retainer to the bottle.

13. A cork screw bottle lock according to claim 11, wherein the retainer is secured to the cork after the cork has been inserted into the bottle.

14. A cork screw bottle lock according claim 11, wherein the retainer is configured to be rotated by a predetermined amount in a tightening direction to secure the cork screw bottle lock to the bottle and is configured to be rotated by a predetermined amount in a loosening direction to remove the cork.

15. A cork screw bottle lock according to claim 11, wherein the retainer is configured to slip over or clamp around the cork.

16. A cork screw bottle lock according to claim 11, further comprising at least one fastener securing the cork to the retainer.

17. A cork screw bottle lock according to claim 11, wherein the at least one gripping element comprises at least one handle.

18. A cork screw bottle lock according to claim 11, wherein the retainer includes two handles extending therefrom, such that the cork screw bottle lock has the appearance of a small person.

19. A cork screw bottle lock according to claim 11, further comprising at least one of:

an embellishment; or a tether configured for tethering the cork screw bottle lock to at least one of the bottle, a wrist, or another object.

20. A method comprising:

providing a cork screw bottle lock according to claim 11;

adding contents to a bottle; and sealing the bottle using a cork secured to the bottle using the cork screw bottle lock.

* * * * *